US010789896B2

(12) United States Patent
Liu et al.

(10) Patent No.: US 10,789,896 B2
(45) Date of Patent: Sep. 29, 2020

(54) METHOD AND DEVICE FOR ADJUSTING A BACKLIGHT

(71) Applicants: BEIJING BOE SPECIAL DISPLAY TECHNOLOGY CO., LTD., Beijing (CN); BOE TECHNOLOGY GROUP CO., LTD., Beijing (CN)

(72) Inventors: Junguo Liu, Beijing (CN); Wenze Yao, Beijing (CN); Shenglin Sun, Beijing (CN); Huizhong Zhu, Beijing (CN)

(73) Assignees: BEIJING BOE SPECIAL DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/331,441

(22) PCT Filed: Jun. 26, 2018

(86) PCT No.: PCT/CN2018/092788
§ 371 (c)(1),
(2) Date: Mar. 7, 2019

(87) PCT Pub. No.: WO2019/033853
PCT Pub. Date: Feb. 21, 2019

(65) Prior Publication Data

US 2019/0197969 A1 Jun. 27, 2019

(30) Foreign Application Priority Data

Aug. 18, 2017 (CN) ..... 2017 1 0711889

(51) Int. Cl.
*G09G 3/34* (2006.01)

(52) U.S. Cl.
CPC ..... *G09G 3/3426* (2013.01); *G09G 3/342* (2013.01); *G09G 2320/0233* (2013.01);
(Continued)

(58) Field of Classification Search
CPC .... G09G 3/3406; G09G 3/342; G09G 3/3426; G09G 2320/0233; G09G 2320/0626; G09G 2320/0633; G09G 2360/16
See application file for complete search history.

(56) References Cited

U.S. PATENT DOCUMENTS

2006/0001381 A1* 1/2006 Robinson ..... H05B 45/20 315/185 R
2007/0115228 A1* 5/2007 Roberts ..... G09G 3/3413 345/82

(Continued)

FOREIGN PATENT DOCUMENTS

CN 102280089 A 12/2011
CN 102376255 A 3/2012

(Continued)

OTHER PUBLICATIONS

First Office Action and English language translation, CN Application No. 201710711889.8, dated Feb. 1, 2019, 26 pp.

(Continued)

*Primary Examiner* — Mihir K Rayan
(74) *Attorney, Agent, or Firm* — Myers Bigel, P.A.

(57) ABSTRACT

A method for adjusting a backlight and a device for adjusting a backlight are provided. A parameter may be set as one of detectable physical quantities of the backlight. The physical quantity, for example, may be a current through a light emitting device, brightness of the light emitting device, or the like. An average value of the parameter is obtained according to values of the parameter which are detected in real time. When the average value is beyond a preset parameter range, a value of the voltage which is input to the light emitting device is adjusted, so that the current through the light emitting device is adjusted, and brightness of the backlight is adjusted. Thereby, brightness of the backlight
(Continued)

can be adjusted in different ways, so that brightness of the backlight can be stable in different environments.

9 Claims, 4 Drawing Sheets

(52) U.S. Cl.
CPC ..... *G09G 2320/0626* (2013.01); *G09G 2320/0633* (2013.01); *G09G 2360/16* (2013.01)

(56) References Cited

U.S. PATENT DOCUMENTS

| | | | | |
|---|---|---|---|---|
| 2011/0248648 | A1* | 10/2011 | Liu | H05B 45/37 315/294 |
| 2012/0105492 | A1 | 5/2012 | Li | |
| 2013/0044272 | A1 | 2/2013 | Gao | |
| 2014/0204131 | A1 | 7/2014 | Chen et al. | |
| 2015/0116382 | A1 | 4/2015 | Im et al. | |
| 2016/0366733 | A1 | 12/2016 | Wang et al. | |
| 2017/0263198 | A1* | 9/2017 | Zhu | G09G 3/3607 |
| 2019/0197969 | A1 | 6/2019 | Liu et al. | |

FOREIGN PATENT DOCUMENTS

| | | | |
|---|---|---|---|
| CN | 103077684 | A | 5/2013 |
| CN | 104883793 | A | 9/2015 |
| CN | 105096842 | A | 11/2015 |
| CN | 106228935 | A | 12/2016 |
| CN | 106782378 | A | 5/2017 |
| CN | 104822198 | B | 12/2017 |
| CN | 107452344 | A | 12/2017 |
| JP | 2014-220200 | A | 11/2014 |
| KR | 10-2015-0049682 | A | 5/2015 |

OTHER PUBLICATIONS

Second Office Action and English language translation, CN Application No. 201710711889.8, dated Jun. 28, 2019, 23 pp.

International Search Report and Written Opinion of the International Searching Authority (with English language translation of Written Opinion), International Application No. PCT/CN2018/092788, dated Aug. 28, 2018, 13 pp.

* cited by examiner

METHOD AND DEVICE FOR ADJUSTING A BACKLIGHT

CROSS REFERENCE TO RELATED APPLICATIONS

The present application is a 35 U.S.C. 371 national stage application of PCT International Application No. PCT/CN2018/092788, filed on Jun. 26, 2018, which claims the benefit of Chinese Patent Application No. 201710711889.8, filed on Aug. 18, 2017, the contents of which are incorporated herein by reference in their entireties. The above-referenced PCT International Application was published in the Chinese language as International Publication No. WO 2019/033853 A1 on Feb. 21, 2019.

TECHNICAL FIELD

The present disclosure relates to the field of display technologies, and particularly to a method and device for adjusting a backlight.

BACKGROUND

A backlight is a light source which is arranged behind a liquid crystal display. The light emitting effect of the backlight directly affects visual effects of the liquid crystal display. Currently, a LED (Light Emitting Diode) is generally used as the backlight of the liquid crystal display.

SUMMARY

Embodiments of the present disclosure provide a method for adjusting a backlight, comprise: obtain a value for a parameter of a light emitting device in the backlight; determine an average value according to the obtained value; and when the average value is beyond a preset parameter range, adjusting a value of voltage which is input to the light emitting device.

Optionally, the light emitting device comprises at least one lamp string.

Optionally, the parameter is current, and adjusting the value of voltage which is input to the light emitting device comprises: when the average value is smaller than a minimum rated current in a preset current range, increasing the value of voltage which is input to the light emitting device; and when the average value is larger than a maximum rated current in the preset current range, decreasing the value of voltage which is input to the light emitting device.

Optionally, increasing the value of voltage which is input to the light emitting device comprises: according to a current difference between the average value and the minimum rated current, determining a first adjustment amount of a duty cycle of a voltage control signal; and increasing the duty cycle of the voltage control signal by the first adjustment amount.

Optionally, decreasing the value of voltage which is input to the light emitting device comprises: according to a current difference between the average value and the maximum rated current, determining a second adjustment amount for the duty cycle of the voltage control signal; and decreasing the duty cycle of the voltage control signal by the second adjustment amount.

Optionally, the parameter is brightness, and adjusting the value of voltage which is input to the light emitting device comprises: when the average value is smaller than a minimum rated brightness in a preset brightness range, increasing the value of voltage which is input to the light emitting device; and when the average value is larger than a maximum rated brightness in the preset brightness range, decreasing the value of voltage which is input to the light emitting device.

Optionally, increasing the value of voltage which is input to the light emitting device comprises: according to a brightness difference between the average value and the minimum rated brightness, determining a third adjustment amount of the duty cycle of the voltage control signal; and increasing the duty cycle of the voltage control signal by the third adjustment amount.

Optionally, decreasing the value of voltage which is input to the light emitting device comprises: according to a brightness difference between the average value and the maximum rated brightness, determining a fourth adjustment amount of the duty cycle of the voltage control signal; and decreasing the duty cycle of the voltage control signal by the fourth adjustment amount.

Embodiments of the present disclosure further provide a device for adjusting a backlight, comprising: a detecting unit configured to obtain a value for a parameter of a light emitting device in the backlight; a determining unit configured to determine an average value according to the obtained value; and a control unit configured to, when the average value is beyond a preset parameter range, adjust a value of voltage which is input to the light emitting device.

Optionally, the parameter is current, and the control unit is configured to: when the average value is smaller than a minimum rated current in a preset current range, increase the value of voltage which is input to the light emitting device; and when the average value is larger than a maximum rated current in the preset current range, decrease the value of voltage which is input to the light emitting device.

Optionally, the control unit is configured to: when the average value is smaller than a minimum rated current in a preset current range, according to a current difference between the average value and the minimum rated current, determine a first adjustment amount of a duty cycle of a voltage control signal; and increase the duty cycle of the voltage control signal by the first adjustment amount.

Optionally, the control unit is configured to: when the average value is larger than a maximum rated current in the preset current range, according to a current difference between the average value and the maximum rated current, determine a second adjustment amount for the duty cycle of the voltage control signal; and decrease the duty cycle of the voltage control signal by the second adjustment amount.

Optionally, the light emitting device comprises at least one lamp string, and the detecting unit comprises at least one current detector, the at least one current detector is connected with the at least one lamp string in a one-to-one corresponding relation.

Optionally, the parameter is brightness, and the control unit is configured to: when the average value is smaller than a minimum rated brightness in a preset brightness range, increase the value of voltage which is input to the light emitting device; and when the average value is larger than a maximum rated brightness in the preset brightness range, decrease the value of voltage which is input to the light emitting device.

Optionally, the control unit is configured to: when the average value is smaller than a minimum rated brightness in a preset brightness range, according to a brightness difference between the average value and the minimum rated brightness, determine a third adjustment amount of the duty cycle of the voltage control signal; and increase the duty cycle of the voltage control signal by the third adjustment amount.

Optionally, the control unit is configured to: when the average value is larger than a maximum rated brightness in the preset brightness range, according to a brightness difference between the average value and the maximum rated brightness, determine a fourth adjustment amount of the duty cycle of the voltage control signal; and decrease the duty cycle of the voltage control signal by the fourth adjustment amount.

Optionally, the light emitting device comprises at least one lamp string; the detecting unit comprises a light sensor which is configured to detect brightness of the at least one lamp string.

DETAILED DESCRIPTION OF EMBODIMENTS

To make the objects, the technical solutions and the advantages of embodiments of the present disclosure more apparent, the technical solutions of the embodiments of the present disclosure will be described in detail hereinafter in conjunction with the drawings of the embodiments of the present disclosure. Apparently, the embodiments described hereinafter are only some embodiments of the present disclosure, but not all embodiments. Based the embodiments described hereinafter, other embodiments obtained by those skilled in the art should fall within the scope of the present disclosure.

Figure 1:
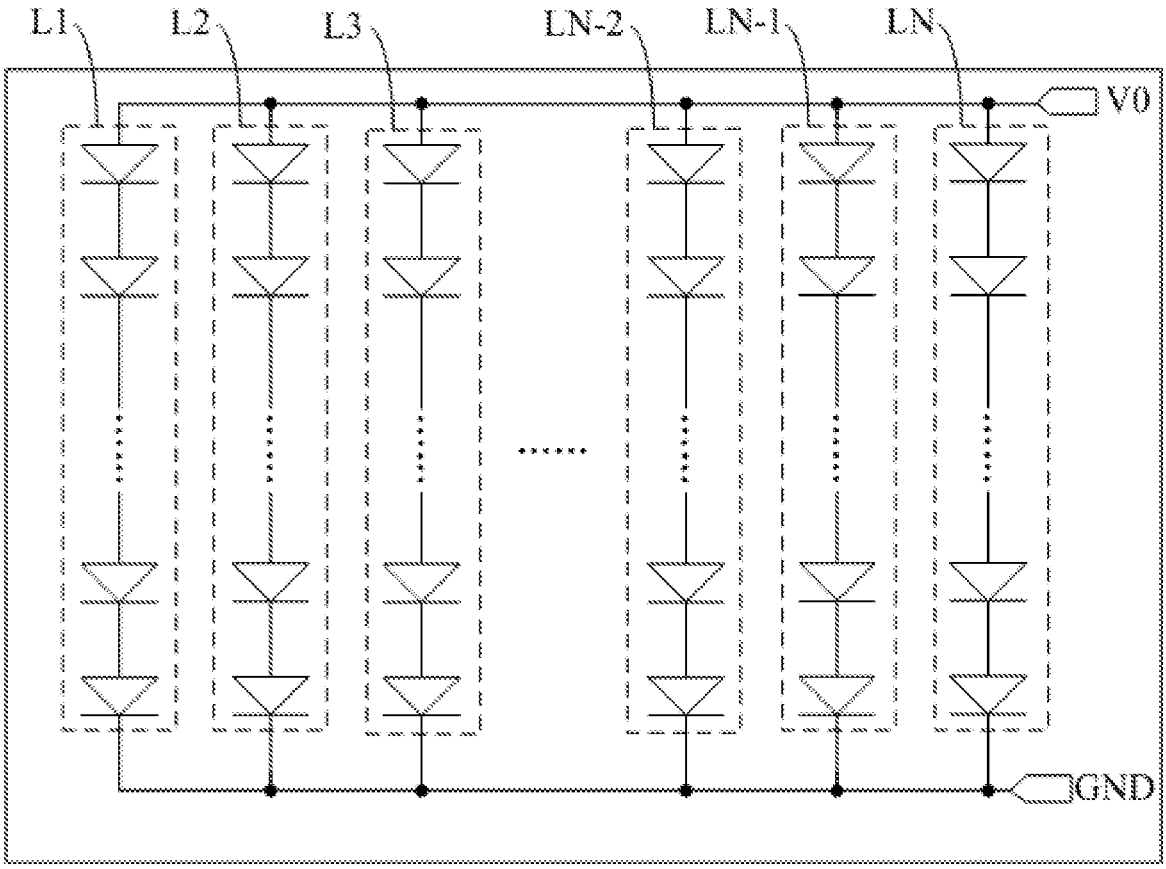
FIG. 1 is a structural view for a backlight in a relevant technique.

In a relevant technique, as shown FIG. 1, a backlight generally comprises a plurality of LED lamp strings Ln (n=1, 2, 3 . . . N, wherein N is a positive integer). Each of the lamp strings Ln comprises LEDs of an equal number which are connected in series. All of these lamp strings Ln are connected between a power source voltage V0 and a ground terminal GND, and are energized by a voltage difference between the power source voltage V0 and the ground terminal GND to emit light. However, in case the backlight operates under an unstable power source voltage or a high environmental temperature, the current through the lamp strings Ln varies, so that brightness of the backlight varies and becomes unstable, which affects display effect of the liquid crystal display. Alternatively, in case the current through a lamp string is stable, the loss due to long-time operation of LEDs of the lamp string causes brightness of the backlight to suffer from dramatic attenuation, which affects display effect of the liquid crystal display. Thus, it is desired to adjust brightness of the backlight during different scenarios.

Figure 2:
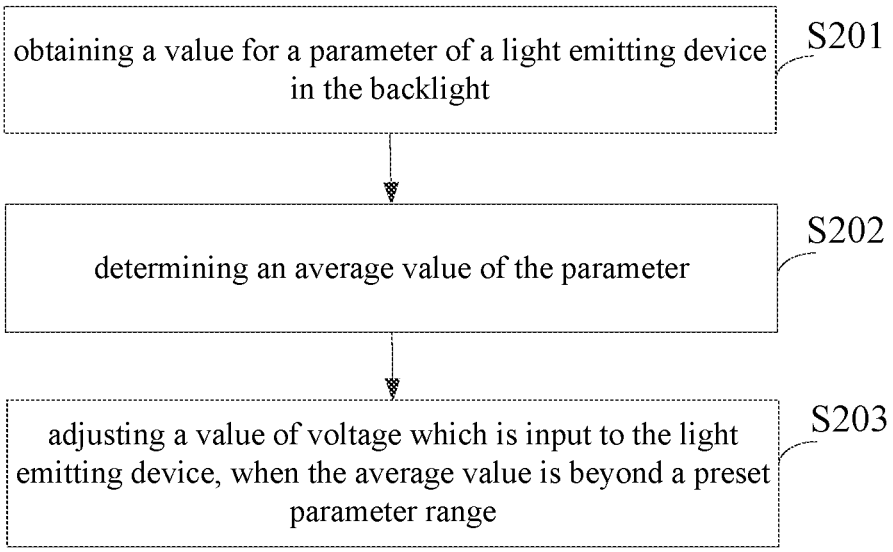
FIG. 2 is a flow chart for a method of adjusting a backlight in an embodiment of the present disclosure.

Embodiments of the present disclosure provide a method for adjusting a backlight. As shown FIG. 2, the method of adjusting a backlight comprises the following steps:

S201, obtaining a value for a parameter of a light emitting device in the backlight;

S202, determining an average value of the parameter, according to the detected values of the parameter;

S203, in case it is determined the average value of the parameter is beyond a preset rated range of the parameter, adjusting a value of voltage which is input to each of the lamp strings.

In the method for adjust a backlight according to embodiment of the present disclosure, the parameter can be set as one of detectable physical quantities of the backlight. The physical quantity for example can be a current through a light emitting device, brightness of the light emitting device, or the like. An average value of the parameter is obtained according to values of the parameter which are detected in real time. When the average value is beyond a preset parameter range, a value of voltage which is input to the light emitting device is adjusted, so that the current through the light emitting device is adjusted, and brightness of the backlight is adjusted. Thereby, brightness of the backlight can be adjusted in different ways, so that brightness of the backlight can be stable in different environments.

The light emitting device in the backlight is generally a LED. Embodiments of the present disclosure will be described hereinafter by referring to a case in which LED is used as the light emitting device in the backlight. In practice, since in the LED of the backlight has its own rated current range and rated brightness range. In case power source voltage which is input to the LED is unstable, for example, increases or decreases, the current through the LED deviates from the rated current range. As a result, brightness of the backlight varies significantly, which will affect stability of the brightness of backlight. Thus, by detecting current through the LED, brightness of the backlight can be adjusted, and in case the backlight is applied to a liquid crystal display, display effect of the liquid crystal display can be improved. Alternatively, in case the backlight is applied to a high temperature environment, a current through the LED will be attenuated due to the characteristics of the LED, and the current through the LED will accordingly deviate from the rated current range, so that brightness of the backlight will be attenuated. Thus, by detecting the current through the LED or brightness of LED, brightness of the backlight can be adjusted, so as to improve display effect of the liquid crystal display. However, even the current through the LED is within the rated current range, the loss due to long-time operation of LED (e.g., for 3, 5 or more years) causes brightness of the LED to suffer from attenuation, so that brightness of the backlight suffers from dramatic attenuation. In this case, brightness of the backlight can be increased firstly to satisfy the brightness requirement for the liquid crystal display to display an image. In this way, brightness of the backlight be adjusted by detecting brightness of the LED, so as to improve display effect of the liquid crystal display.

In some embodiments, in step S201, the value for the parameter of the light emitting device in the backlight for example can be obtained in real time, so that brightness of the backlight is adjusted in real time.

In some embodiments, the light emitting device comprises at least one lamp string. The light emitting device can also be a single light emitting device or a single lamp string. In this case, values of the parameter of the light emitting device can be obtained in several times, so that the average value is obtained.

In practice, in the adjusting method according to embodiments of the present disclosure, the current through the LED is taken as the parameter, i.e., the parameter is the current. The preset current range can be a range defined by $I_0 \pm \Delta I$, wherein $I_0$ represents an average value of a rated current of all lamp strings in the backlight, and $\Delta I$ represents a value by which the current can deviate from $I_0$ within the allowable error. In practice, specific values of $I_0$ and $\Delta I$ are set according to practical needs, which are not defined here.

In practice, in the adjusting method according to embodiments of the present disclosure, the parameter is current, and adjusting the value of voltage which is input to the light emitting device comprises: when the average value is smaller than a minimum rated current in a preset current range, increasing the value of voltage which is input to the light emitting device; and when the average value is larger than a maximum rated current in the preset current range, decreasing the value of voltage which is input to the light emitting device.

In particular, in case the parameter is current, reference is made to a case in which the backlight comprises 6 lamp strings L1~L6, V0 represents the power source voltage which is input to 6 lamp strings, $I_{min}$ represents the minimum rated current in a preset rated current range, $I_{max}$ represents the maximum rated current in the preset rated current range. By detecting in real time values of corresponding currents of 6 lamp strings L1~L6 in the backlight, six values of current $I_1$, $I_2$, $I_3$, $I_4$, $I_5$, $I_6$ can be obtained. The average value $\bar{I}$ for these 6 current values is $\bar{I}=I_1+I_2+I_3+I_4+I_5+I_6/6$. In case $\bar{I}<I_{min}$, the value of voltage V0 which is input to these 6 lamp strings L1~L6 is increased. When the increased value of voltage V0 is input to these 6 lamp strings L1~L6, the value of currents $I_1$, $I_2$, $I_3$, $I_4$, $I_5$, $I_6$ through these 6 lamp strings L1~L6 can be also increased, so that $\bar{I}$ is increased. In this way, $\bar{I}$ is adjusted towards the preset rated range of current, and satisfies the preset rated range of current. Thus brightness of the backlight is adjusted, and brightness of the backlight is stable. In case $\bar{I}>I_{max}$, the value of voltage V0 which is input to these 6 lamp strings L1~L6 is decreased. When the decreased value of voltage V0 is input to these 6 lamp strings L1~L6, the value of currents $I_1$, $I_2$, $I_3$, $I_4$, $I_5$, $I_6$ through these 6 lamp strings L1~L6 can also be decreased, so that $\bar{I}$ is decreased. In this way, $\bar{I}$ is adjusted towards the preset rated range of current, and satisfies the preset rated range of current. Thus brightness of the backlight is adjusted, and brightness of the backlight is stable.

In practice, in the adjusting method according to embodiments of the present disclosure, the brightness of the LED is taken as the parameter, i.e., the parameter is the brightness. The preset brightness range can be a range defined by $Lm_0 \pm \Delta Lm$, wherein $Lm_0$ represents an average value of a rated brightness of all lamp strings in the backlight, and $\Delta Lm$ represents a value by which the brightness can be deviated from $Lm_0$ within the allowable error. In practice, specific values of $Lm_0$ and $\Delta Lm$ are set according to practical needs, which are not defined here.

In practice, in the adjusting method according to embodiments of the present disclosure, the parameter is brightness, and adjusting the value of voltage which is input to the light emitting device comprises: when the average value is smaller than a minimum rated brightness in a preset brightness range, increasing the value of voltage which is input to the light emitting device; and when the average value is larger than a maximum rated brightness in the preset brightness range, decreasing the value of voltage which is input to the light emitting device.

In particular, in case the parameter is brightness, reference is made to a case in which the backlight comprises 6 lamp strings L1~L6, V0 represents the power source voltage which is input to 6 lamp strings, $Lm_{min}$ represents the minimum rated brightness in a preset rated brightness range, $Lm_{max}$ represents the maximum rated brightness in a preset rated brightness range. By detecting in real time values of corresponding brightness of 6 lamp strings L1~L6 in the backlight, six values of currents $Lm_1$, $Lm_2$, $Lm_3$, $Lm_4$, $Lm_5$, $Lm_6$ can be obtained. The average value $\overline{Lm}$ for these 6 brightness values is $\overline{Lm}=Lm_1+Lm_2+Lm_3+Lm_4+Lm_5+Lm_6/6$. In case $\overline{Lm}<Lm_{min}$, the value of voltage V0 which is input to these 6 lamp strings L1~L6 is increased. When the increased value of voltage V0 is input to these 6 lamp strings L1~L6, the value of currents $I_1$, $I_2$, $I_3$, $I_4$, $I_5$, $I_6$ through these 6 lamp strings L1~L6 can also be increased, so that the brightness of these 6 lamp strings L1~L6 is increased, and $\overline{Lm}$ is increased. In this way, $\overline{Lm}$ is adjusted towards the preset rated range of brightness, and satisfies the preset rated range of brightness. Thus brightness of the backlight is adjusted, and brightness of the backlight is stable. In case $\overline{Lm}>Lm_{max}$, the value of voltage V0 which is input to these 6 lamp strings L1~L6 is decreased. When the decreased value of voltage V0 is input to these 6 lamp strings L1~L6, the value of currents $I_1$, $I_2$, $I_3$, $I_4$, $I_5$, $I_6$ through these 6 lamp strings L1~L6 can also be decreased, the brightness of these 6 lamp strings L1~L6 is decreased, and $\overline{Lm}$ is decreased. In this way, $\overline{Lm}$ is adjusted towards the preset rated range of brightness, and satisfies the preset rated range of brightness. Thus brightness of the backlight is adjusted, and brightness of the backlight is stable.

The procedure of increasing or decreasing the value of voltage which is input to each of the lamp strings will be described hereinafter in embodiments in which the parameter is current or brightness.

In some embodiments, the parameter is current, and increasing the value of voltage which is input to the light emitting device comprises: according to a current difference between the average value and the minimum rated current, determining a first adjustment amount of a duty cycle of a voltage control signal; and increasing the duty cycle of the voltage control signal by the first adjustment amount.

In practice, the voltage control signal is a PWM (Pulse Width Modulation) signal which can be modulated in terms of its pulse width. The duty cycle of the voltage control signal is a time ratio by which its effective pulse signal occupies the voltage control signal. The effective pulse signal of the voltage control signal is used to control the value of voltage which is output to the lamp strings. The larger the duty cycle of the voltage control signal is, the more power is output to the lamp strings. In practice, a control signal which is generally used to control the magnitude of value of voltage output to the lamp strings can be taken as the voltage control signal.

In practice, in the adjusting method according to embodiments of the present disclosure, a corresponding relation between the current difference between the average value of the current and the minimum rated value and the first adjustment amount of the duty cycle is stored in advanced. The corresponding relation is: the larger the current difference between the average value of the current and the minimum rated value is, the larger the first adjustment amount of the corresponding duty cycle is. In practice, the pre-stored corresponding relation between the current difference between the average value of the current and the minimum rated value and the first adjustment amount of the duty cycle is a corresponding relation which can be obtained by a person with ordinary skill in the art based on experience, and is designed according to practical needs, which is not repeated for simplicity.

Figure 3:
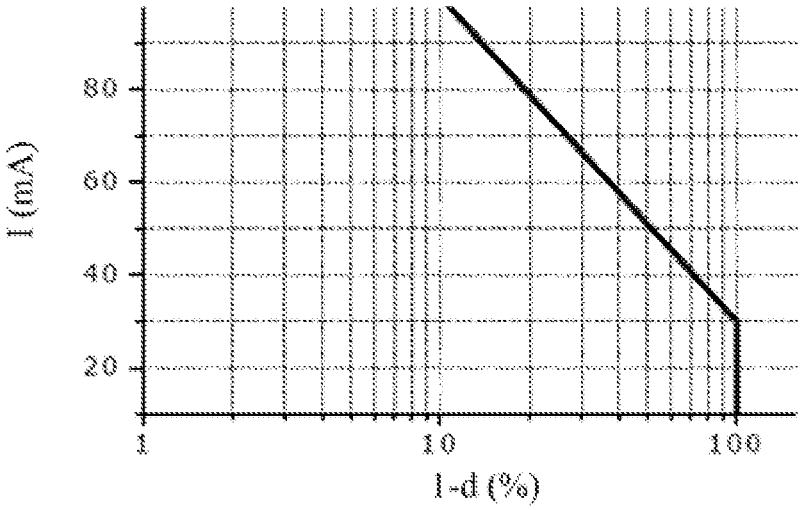
FIG. 3 is a schematic view for a corresponding relation between a duty cycle of the voltage control signal and current through a lamp string in an embodiment of the present disclosure.

FIG. 3 is a schematic view for a corresponding relation between the duty cycle of the voltage control signal and the current through the lamp string. The abscissa represents a difference between the unit 1 and the duty cycle d, and the ordinate represents the value of current I.

In particular, according to FIG. 3, the larger the duty cycle of the voltage control signal is, the larger the current through the lamp string is. In an example, in case $I_0$=60 mA and ΔI=0.5 mA, $I_{min}$=59.5 mA. When the determined average value of the current is $\bar{I}$=50 mA, the current difference between the average value $\bar{I}$ and the minimum rated value $I_{min}$ is 9.5 mA. According to the current difference of 9.5 mA, the first adjustment amount $\Delta d_1$ by which the duty cycle is adjusted can be obtained. The duty cycle of the voltage control signal is adjusted according to first adjustment amount $\Delta d_1$, so that the duty cycle of the voltage control signal is increased by $\Delta d_1$, and the duty cycle of the voltage control signal which is increased by $\Delta d_1$ tends to be, within the allowable error, the duty cycle of the voltage control signal to which $I_0$ corresponds. As a result, the increase in the value of voltage which is input to each of the lamp strings is determined according to the voltage control signal with the adjusted duty cycle, and the current through each of the lamp strings is increased. In this way, the average value $\bar{I}$ of the current through each of the lamp strings which has been adjusted tends to be $I_0$ within the allowable error.

It is noted that FIG. 3 only shows an exemplary diagram, which is only used to schematically show the corresponding relation between the duty cycle of the voltage control signal and the current through the lamp string. In the present disclosure, the pre-stored corresponding relation between the current difference between the average value of the current and the minimum rated value and the first adjustment amount of the duty cycle is not limited to this.

In some embodiments, the parameter is current, and decreasing the value of voltage which is input to the light emitting device comprises: according to a current difference between the average value and the maximum rated current, determining a second adjustment amount for the duty cycle of the voltage control signal; and decreasing the duty cycle of the voltage control signal by the second adjustment amount.

In practice, the voltage control signal is a PWM signal which can be modulated in terms of its pulse width. The duty cycle of the voltage control signal is a time ratio by which its effective pulse signal occupies the voltage control signal. The effective pulse signal of the voltage control signal is used to control the value of voltage which is output to the lamp strings. The larger the duty cycle of the voltage control signal is, the more power is output to the lamp strings. In practice, a control signal which is generally used to control the magnitude of value of voltage output to the lamp strings can be taken as the voltage control signal.

In practice, in the adjusting method according to embodiments of the present disclosure, a corresponding relation between the current difference between the average value of the current and the maximum rated value and the second adjustment amount of the duty cycle is stored in advanced. The corresponding relation is: the larger the current difference between the average value of the current and the maximum rated value is, the larger the second adjustment amount of the corresponding duty cycle is. In practice, the pre-stored corresponding relation between the current difference between the average value of the current and the maximum rated value and the second adjustment amount of the duty cycle is a corresponding relation which can be obtained by the person with ordinary skill in the art based on experience, which is not repeated for simplicity.

In particular, according to FIG. 3, the larger the duty cycle of the voltage control signal is, the larger the current through the lamp string is. In an example, in case $I_0$=60 mA and ΔI=0.5 mA, $I_{max}$=60.5 mA. When the determined average value of the current is $\bar{I}$=70 mA, the current difference between the average value $\bar{I}$ and the maximum rated value $I_{max}$ is 9.5 mA. According to the current difference of 9.5 mA, the second adjustment amount $\Delta d_2$ by which the duty cycle is adjusted can be obtained. The duty cycle of the voltage control signal is adjusted according to the second adjustment amount $\Delta d_2$, so that the duty cycle of the voltage control signal is decrease by $\Delta d_2$, and the duty cycle of the voltage control signal which is decreased by $\Delta d_2$ tends to be, within the allowable error, the duty cycle of the voltage control signal to which $I_0$ corresponds. As a result, the decrease in the value of voltage which is input to each of the lamp strings is determined according to the voltage control signal with the adjusted duty cycle, and the current through each of the lamp strings is decreased. In this way, the average value $\bar{I}$ of the current through each of the lamp strings which has been adjusted tends to be $I_0$ within the allowable error.

It is noted that FIG. 3 only shows an exemplary diagram, which is only used to schematically show the corresponding relation between the duty cycle of the voltage control signal and the current through the lamp string. In the present disclosure, the pre-stored corresponding relation between the current difference between the average value of the current and the maximum rated value and the first adjustment amount of the duty cycle is not limited to this.

In some embodiments, the parameter is brightness, and increasing the value of voltage which is input to the light emitting device comprises: according to a brightness difference between the average value and the minimum rated brightness, determining a third adjustment amount of the duty cycle of the voltage control signal; and increasing the duty cycle of the voltage control signal by the third adjustment amount.

In practice, the voltage control signal is a PWM signal which can be modulated in terms of its pulse width. The duty cycle of the voltage control signal is a time ratio by which its effective pulse signal occupies the voltage control signal. The effective pulse signal of the voltage control signal is used to control the value of voltage which is output to the lamp strings. The larger the duty cycle of the voltage control signal is, the more power is output to the lamp strings. In practice, a control signal which is generally used to control the magnitude of value of voltage output to the lamp strings can be taken as the voltage control signal.

In practice, in the adjusting method according to embodiments of the present disclosure, a corresponding relation between the brightness difference between the average value of the brightness and the minimum rated value and a third adjustment amount of the duty cycle is stored in advanced. The corresponding relation is: the larger the brightness difference between the average value of the brightness and the minimum rated value is, the larger the third adjustment amount of the corresponding duty cycle is. In practice, the pre-stored corresponding relation between the brightness difference between the average value of the brightness and the minimum rated value and the third adjustment amount of the duty cycle is a corresponding relation which can be obtained by the person with ordinary skill in the art based on experience, which is not repeated for simplicity.

In particular, when the brightness difference between the average value of brightness $\overline{Lm}$ and the minimum rated value of brightness $Lm_{min}$ is determined, a third adjustment amount $\Delta d_3$ by which the duty cycle is adjusted can be obtained according to the brightness difference. The duty cycle of the voltage control signal is adjusted according to the third adjustment amount $\Delta d_3$, so that the duty cycle of the voltage control signal is increased by $\Delta d_3$. In this way, the duty cycle of the voltage control signal which is increased by $\Delta d_3$ tends to be, within the allowable error, the duty cycle of the voltage control signal to which $Lm_0$ corresponds. As a result, the increase in the value of voltage which is input to each of the lamp strings is determined according to the voltage control signal with the adjusted duty cycle, and the current through each of the lamp strings is increased. In this way, the average value of brightness $\overline{Lm}$ of each of the lamp strings which has been adjusted tends to be $Lm_0$ within the allowable error.

In some embodiments, the parameter is brightness, and decreasing the value of voltage which is input to the light emitting device comprises: according to a brightness difference between the average value and the maximum rated brightness, determining a fourth adjustment amount of the duty cycle of the voltage control signal; and decreasing the duty cycle of the voltage control signal by the fourth adjustment amount.

In practice, the voltage control signal is a PWM signal which can be modulated in terms of its pulse width. The duty cycle of the voltage control signal is a time ratio by which its effective pulse signal occupies the voltage control signal. The effective pulse signal of the voltage control signal is used to control the value of voltage which is output to the lamp strings. The larger the duty cycle of the voltage control signal is, the more power is output to the lamp strings. In practice, a control signal which is generally used to control the magnitude of value of voltage output to the lamp strings can be taken as the voltage control signal.

In practice, in the adjusting method according to embodiments of the present disclosure, a corresponding relation between the brightness difference between the average value of brightness and the maximum rated value and a fourth adjustment amount of the duty cycle is stored in advanced. The corresponding relation is: the larger the brightness difference between the average value of brightness and the maximum rated value is, the larger the fourth adjustment amount of the corresponding duty cycle is. In practice, the pre-stored corresponding relation between the brightness difference between the average value of brightness and the maximum rated value and the fourth adjustment amount of the duty cycle can be obtained by the person with ordinary skill in the art based on experience corresponding relation, and is designed according to practical needs, which is not repeated for simplicity.

In particular, when the brightness difference between the average value of brightness $\overline{Lm}$ and the maximum rated value of brightness $Lm_{max}$ is determined, a fourth adjustment amount $\Delta d_4$ by which the duty cycle is adjusted can be obtained according to the brightness difference. The duty cycle of the voltage control signal is adjusted according to the fourth adjustment amount $\Delta d_4$, so that the duty cycle of the voltage control signal is decreased by $\Delta d_4$. In this way, the duty cycle of the voltage control signal which is decreased by $\Delta d_4$ tends to be, within the allowable error, the duty cycle of the voltage control signal to which $Lm_0$ corresponds. As a result, the decrease in the value of voltage which is input to each of the lamp strings is determined according to the voltage control signal with the adjusted duty cycle, and the current through each of the lamp strings is increased. In this way, the average value of brightness $\overline{Lm}$ of each of the lamp strings which has been adjusted tends to be $Lm_0$ within the allowable error.

Figure 4:
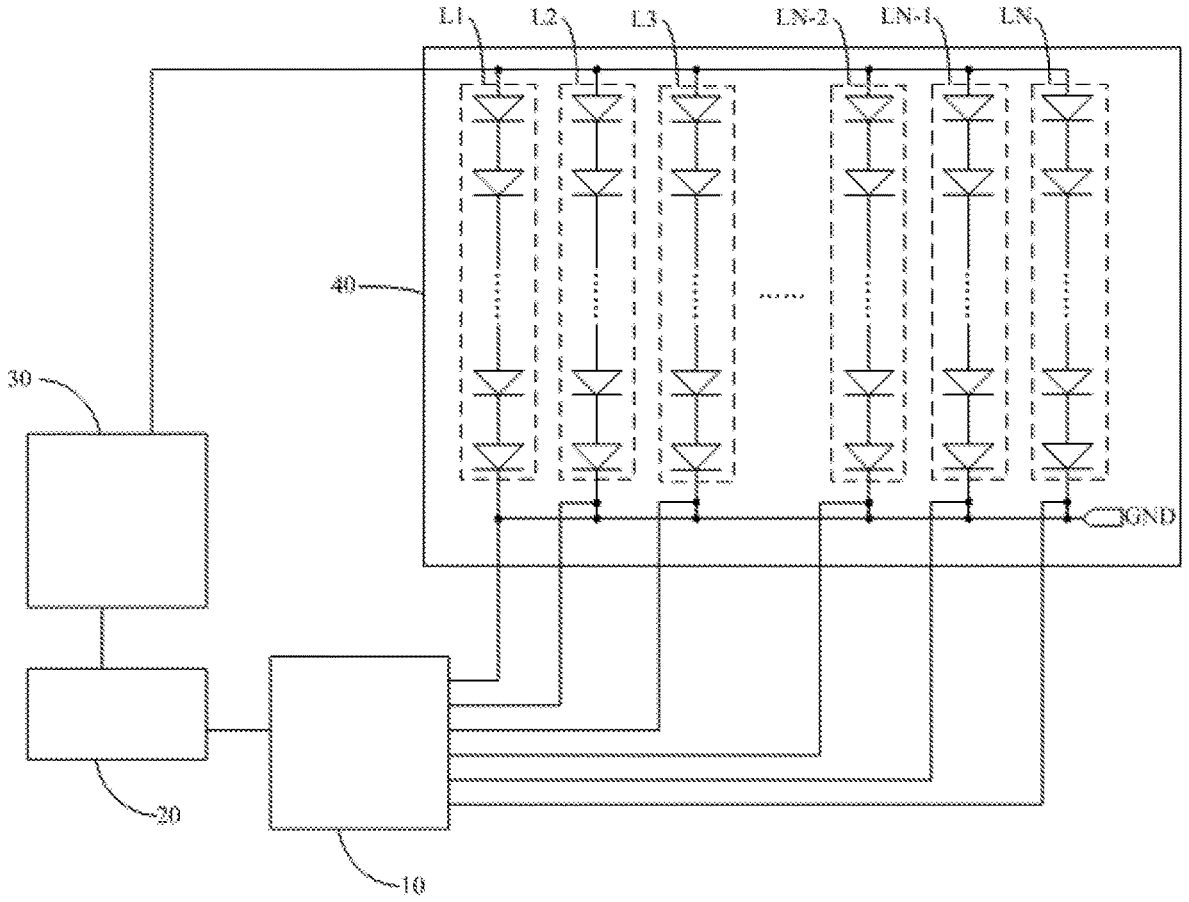
FIG. 4 is a structural view for a device for adjusting a backlight in an embodiment of the present disclosure.

On basis of a same concept, embodiments of the present disclosure further provide a device for adjusting a backlight. A shown FIG. 4, the device comprises: a detecting unit 10, configured to obtain a value for a parameter of a light emitting device (L1~LN) in a backlight; a determining unit 20, configured to determine an average value according to the obtained value; and a control unit 30, configured to, when the average value is beyond a preset parameter range, adjust a value of voltage which is input to the light emitting device.

In the device for adjusting a backlight according to an embodiment of the present disclosure, the parameter can be set as one of detectable physical quantities of the backlight. The physical quantity for example can be a current through a light emitting device, brightness of the light emitting device, or the like. An average value of the parameter is obtained according to values of the parameter which are detected in real time. When the average value is beyond a preset parameter range, a value of voltage which is input to the light emitting device is adjusted, so that the current through the light emitting device is adjusted, and brightness of the backlight is adjusted. Thereby, brightness of the backlight can be adjusted in different ways, so that brightness of the backlight can be stable in different environments In practice, in the device according to embodiments of the present disclosure, the current through the LED is taken as the parameter, i.e., the parameter is current. The preset current range can be defined by $I_0 \pm \Delta I$, wherein $I_0$ represents the average value of the rated current for all lamp strings in the backlight, $\Delta I$ represents a value by which the current can deviate from $I_0$ within the allowable error. In practice, specific values of $I_0$ and $\Delta I$ are set according to practical needs, which are not defined here.

In practice, in the device according to embodiments of the present disclosure, the parameter is current, and the control unit is configured to: when the average value is smaller than a minimum rated current in a preset current range, increase the value of voltage which is input to the light emitting device; and when the average value is larger than a maximum rated current in the preset current range, decrease the value of voltage which is input to the light emitting device.

In some embodiments, the control unit is configured to: when the average value is smaller than a minimum rated current in a preset current range, according to a current difference between the average value and the minimum rated current, determine a first adjustment amount of a duty cycle of a voltage control signal; and increase the duty cycle of the voltage control signal by the first adjustment amount. In practice, in the device according to embodiments of the present disclosure, a corresponding relation between the current difference between the average value of the current and the minimum rated value and the first adjustment amount of the duty cycle is stored in advanced. The corresponding relation is: the larger the current difference between the average value of the current and the minimum rated value is, the larger the first adjustment amount of the corresponding duty cycle is. In practice, the pre-stored corresponding relation between the current difference between the average value of the current and the minimum rated value and the first adjustment amount of the duty cycle is a corresponding relation which can be obtained by the person with ordinary skill in the art based on experience, which is not repeated for simplicity.

In some embodiments, when the average value is larger than a maximum rated current in the preset current range, according to a current difference between the average value and the maximum rated current, a second adjustment amount for the duty cycle of the voltage control signal is determined; and the duty cycle of the voltage control signal is decreased by the second adjustment amount. In practice, in the device according to embodiments of the present disclosure, is stored in advanced the corresponding relation between the current difference between the average value of the current and the maximum rated value and the second adjustment amount of the duty cycle. The corresponding relation is: the larger the current difference between the average value of the current and the maximum rated value is, the larger the second adjustment amount of the corresponding duty cycle is. In practice, the pre-stored corresponding relation between the current difference between the average value of the current and the maximum rated value and the second adjustment amount of the duty cycle is a corresponding relation which can be obtained by the person with ordinary skill in the art based on experience, which is not repeated for simplicity.

Figure 5:
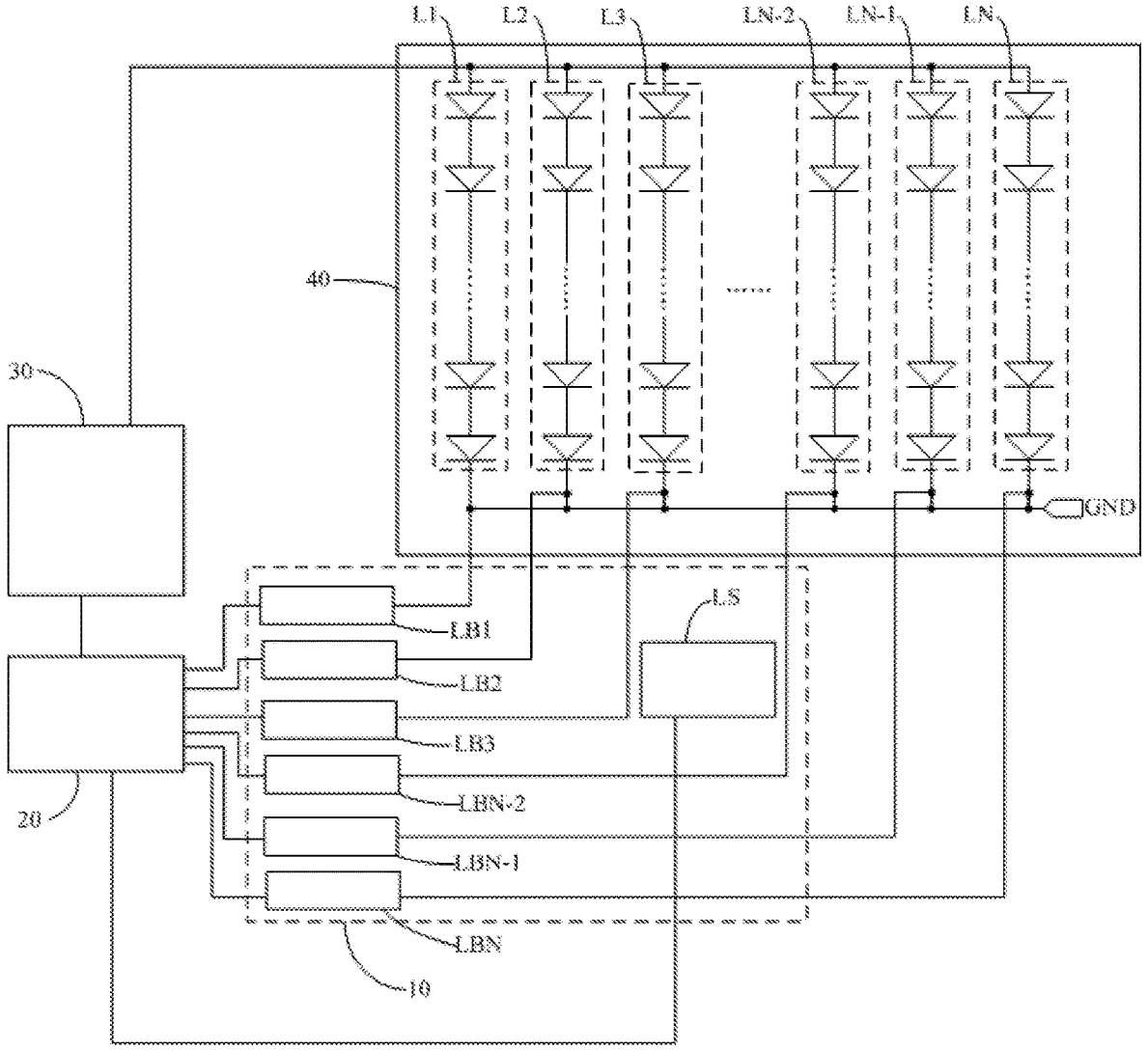
FIG. 5 is a structural view for a device for adjusting a backlight in another embodiment of the present disclosure.

In case the parameter is current, in the device according to embodiments of the present disclosure, as shown FIG. 5, optionally, the light emitting device comprises at least one lamp string (L1~LN); the detecting unit 10 comprises at least one current detector (LB1~LBN), the at least one current detector is connected with the at least one lamp string in a one-to-one corresponding relation. In particular, each current detector can be used to detect in real time the value of current through the lamp string to which it is connected, and feed the detected the value of current to the determining unit 20. In practice, a common current detector can be used as the current detector in embodiments of in the present disclosure, which is not repeated for simplicity.

In practice, in the device according to embodiments of the present disclosure, the brightness of the LED is taken as the parameter, i.e., the parameter is brightness. The preset rated range of brightness can be defined by $Lm_0 \pm \Delta Lm$, wherein $Lm_0$ represents the average value of rated brightness of all lamp strings in the backlight, $\Delta Lm$ represents a value by which the brightness can deviate from $Lm_0$ within the allowable error. In practice, specific values of $Lm_0$ and $\Delta Lm$ are set according to practical needs, which are not defined here.

In practice, in the device according to embodiments of the present disclosure, the parameter is brightness, and the control unit is configured to: when the average value is smaller than a minimum rated brightness in a preset brightness range, increase the value of voltage which is input to the light emitting device; and when the average value is larger than a maximum rated brightness in the preset brightness range, decrease the value of voltage which is input to the light emitting device.

In some embodiments, the control unit is configured to: when the average value is smaller than a minimum rated brightness in a preset brightness range, according to a brightness difference between the average value and the minimum rated brightness, determine a third adjustment amount of the duty cycle of the voltage control signal; and increase the duty cycle of the voltage control signal by the third adjustment amount. In practice, in the device according to embodiments of the present disclosure, is stored in advanced a corresponding relation between the brightness difference between the average value of the brightness and the minimum rated value and the third adjustment amount of the duty cycle. The corresponding relation is: the larger the brightness difference between the average value of the brightness and the minimum rated value is, the larger the third adjustment amount of the corresponding duty cycle is. In practice, the pre-stored corresponding relation between the brightness difference between the average value of the brightness and the minimum rated value and the third adjustment amount of the duty cycle is a corresponding relation which can be obtained by the person with ordinary skill in the art based on experience, which is not repeated for simplicity.

In some embodiments, the control unit is configured to: when the average value is larger than a maximum rated brightness in the preset brightness range, according to a brightness difference between the average value and the maximum rated brightness, determine a fourth adjustment amount of the duty cycle of the voltage control signal; and decrease the duty cycle of the voltage control signal by the fourth adjustment amount. In practice, in the device according to embodiments of the present disclosure, is stored in advanced the corresponding relation between the brightness difference between the average value of brightness and the maximum rated value and the fourth adjustment amount of the duty cycle. The corresponding relation is: the larger the brightness difference between the average value of brightness and the maximum rated value is, the larger the fourth adjustment amount of the corresponding duty cycle is. In practice, the pre-stored corresponding relation between the brightness difference between the average value of brightness and the maximum rated value and the fourth adjustment amount of the duty cycle is a corresponding relation which can be obtained by the person with ordinary skill in the art based on experience, which is not repeated for simplicity.

In some embodiments, as shown FIG. 5, the light emitting device comprises at least one lamp string (L1~LN), and the detecting unit 10 comprises a light sensor LS. The light sensor LS is configured to detect the brightness of at least one lamp string (L1~LN), and feed the value of the detected brightness to the determining unit 20. In practice, a common light sensor can be used as the light sensor in embodiments of in the present disclosure, which is not repeated for simplicity.

In the context of the present disclosure, respective "unit" and "module" in each embodiment can be implemented by a computer or by a computer in combination with suitable sensors. The processing procedure of each unit and module can for example realized by a processor in the computer.

In practice, in the device according to embodiments of the present disclosure, the determining unit 20 can comprise a first processor which is formed by software and hardware. The first processor is used to determine the average value of the parameter according to values of the detected parameter. In practice, it is understood by the person with ordinary skill in the art that the specific structure of the first processor is designed according to practical needs.

In practice, in the device according to embodiments of the present disclosure, the control unit 30 can comprise a second processor which is formed by software and hardware. The second processor is used to adjust the value of voltage which is input to each of the lamp strings, in case it is determined the average value of the parameter is beyond a preset rated range of the parameter. In practice, it is understood by the person with ordinary skill in the art that the specific structure of the second processor is designed according to practical needs.

In the method for adjusting a backlight and a device for adjusting a backlight according to embodiments of the present disclosure. The parameter can be set as one of detectable physical quantities of the backlight. The physical quantity for example can be a current through a light emitting device, brightness of the light emitting device, or the like. An average value of the parameter is obtained according to values of the parameter which are detected in real time. When the average value is beyond a preset parameter range, a value of voltage which is input to the light emitting device is adjusted, so that the current through the light emitting device is adjusted, and brightness of the backlight is adjusted. Thereby, brightness of the backlight can be adjusted in different ways, so that brightness of the backlight can be stable in different environments Apparently, the person with ordinary skill in the art can make various modifications and variations to the present disclosure without departing from the spirit and the scope of the present disclosure. In this way, provided that these modifications and variations of the present disclosure belong to the scopes of the claims of the present disclosure and the equivalent technologies thereof, the present disclosure also intends to encompass these modifications and variations.

What is claimed is:

1. A method for adjusting a backlight, comprising:

obtaining a value for a parameter of a light emitting device in the backlight;

determining an average value according to the value of the parameter that was obtained; and adjusting a value of a voltage which is input to the light emitting device, when the average value is outside of a preset parameter range, wherein the parameter comprises current, and adjusting the value of the voltage which is input to the light emitting device comprises when the average value is less than a minimum rated current in a preset current range, increasing the value of the voltage which is input to the light emitting device, and when the average value is greater than a maximum rated current in the preset current range, decreasing the value of the voltage which is input to the light emitting device, or wherein the parameter comprises brightness, and the adjusting the value of the voltage which is input to the light emitting device comprises when the average value is less than a minimum rated brightness in a preset brightness range, increasing the value of the voltage which is input to the light emitting device, and when the average value is greater than a maximum rated brightness in the preset brightness range, decreasing the value of the voltage which is input to the light emitting device.

2. A device for adjusting a backlight, comprising:

a detecting circuit configured to obtain a value for a parameter of a light emitting device in the backlight;

a determining circuit configured to determine an average value according to the value for the parameter that was obtained; and a control circuit configured to, when the average value is beyond a preset parameter range, adjust a value of a voltage which is input to the light emitting device, wherein the parameter comprises current, and the control circuit is configured to:

when the average value is less than a minimum rated current in a preset current range, increase the value of the voltage which is input to the light emitting device; and when the average value is greater than a maximum rated current in the preset current range, decrease the value of the voltage which is input to the light emitting device.

3. The device of claim 2, wherein the control circuit is configured to:

when the average value is less than a minimum rated current in a preset current range, according to a current difference between the average value and the minimum rated current, determine a first adjustment amount of a duty cycle of a voltage control signal; and increase the duty cycle of the voltage control signal by the first adjustment amount.

4. The device of claim 2, wherein the control circuit is configured to:

when the average value is greater than a maximum rated current in the preset current range, according to a current difference between the average value and the maximum rated current, determine a second adjustment amount for a duty cycle of a voltage control signal; and decrease the duty cycle of the voltage control signal by the second adjustment amount.

5. The device of claim 2, wherein the light emitting device comprises at least one lamp string, wherein the detecting circuit comprises at least one current detector, and wherein the at least one current detector is connected with the at least one lamp string in a one-to-one corresponding relation.

6. A device for adjusting a backlight, comprising:

a detecting circuit configured to obtain a value for a parameter of a light emitting device in the backlight;

a determining circuit configured to determine an average value according to the value for the parameter that was obtained; and a control circuit configured to, when the average value is beyond a preset parameter range, adjust a value of a voltage which is input to the light emitting device, wherein the parameter comprises brightness, and the control circuit is configured to:

when the average value is less than a minimum rated brightness in a preset brightness range, increase the value of the voltage which is input to the light emitting device; and when the average value is greater than a maximum rated brightness in the preset brightness range, decrease the value of the voltage which is input to the light emitting device.

7. The device of claim 6, wherein the control circuit is configured to:

when the average value is less than a minimum rated brightness in a preset brightness range, according to a brightness difference between the average value and the minimum rated brightness, determine a third adjustment amount of a duty cycle of the voltage control signal; and increase the duty cycle of the voltage control signal by the third adjustment amount.

8. The device of claim 6, wherein the control circuit is configured to:

when the average value is greater than a maximum rated brightness in the preset brightness range, according to a brightness difference between the average value and the maximum rated brightness, determine a fourth adjustment amount of a duty cycle of the voltage control signal; and decrease the duty cycle of the voltage control signal by the fourth adjustment amount.

9. The device of claim 6, wherein the light emitting device comprises at least one lamp string, and wherein the detecting circuit comprises a light sensor which is configured to detect brightness of the at least one lamp string.

* * * * *